US006286333B1

(12) United States Patent
Hagström et al.

(10) Patent No.: US 6,286,333 B1
(45) Date of Patent: Sep. 11, 2001

(54) METHOD OF GENERATING A GAS FLOW OF MEDIUM PRESSURE AND MEDIUM TEMPERATURE FROM A GAS FLOW OF HIGH PRESSURE AND HIGH TEMPERATURE AND APPLIANCE FOR CARRYING OUT THE METHOD

(75) Inventors: Gustav Hagström, Nussbaumen; Jakob Keller, deceased, late of Wohlen, both of (CH), by Maria Keller-Schärli, Andreas Jakob Keller, Vera Keller, Georg Keller, legal representatives

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/405,227

(22) Filed: Sep. 27, 1999

(30) Foreign Application Priority Data

Oct. 19, 1998 (EP) ..... 98811042

(51) Int. Cl.[7] ..... F25D 9/00
(52) U.S. Cl. ..... 62/401
(58) Field of Search ..... 62/401, 402

(56) References Cited

U.S. PATENT DOCUMENTS 5,311,749 * 5/1994 McAuliffe et al. ..... 62/402
5,461,882 * 10/1995 Zywiak ..... 62/401
6,070,418 * 6/2000 Crabtree et al. ..... 62/86

* cited by examiner

*Primary Examiner*—William Doerrler
*Assistant Examiner*—Malik Drake
(74) *Attorney, Agent, or Firm*—Burns, Doane, Swecker & Mathis, L.L.P.

(57) ABSTRACT

In a method of generating a third gas flow of medium pressure and medium temperature, which can be particularly employed as cooling air for a gas turbine, from a first gas flow of high-pressure and high temperature, a high effectiveness with simultaneous simple process control is achieved in an arrangement wherein the reduction is undertaken by stepwise energy exchange between the first gas flow and a second gas flow of low pressure and low temperature in a cascade consisting of a plurality of energy exchangers connected in series.

7 Claims, 6 Drawing Sheets

METHOD OF GENERATING A GAS FLOW OF MEDIUM PRESSURE AND MEDIUM TEMPERATURE FROM A GAS FLOW OF HIGH PRESSURE AND HIGH TEMPERATURE AND APPLIANCE FOR CARRYING OUT THE METHOD

BACKGROUND OF THE INVENTION

1. Field of the Invention

The present invention pertains to the field of fluid mechanics. It relates to a method of generating a third gas flow of medium pressure and medium temperature, which can be particularly employed as cooling air for a gas turbine, from a first gas flow of high pressure and high temperature.

The invention also relates to an appliance for carrying out the method.

2. Discussion of Background

A particular difficulty associated with the cooling of gas turbines consists in the fact that only a limited number of pressure stages are available on the compressor for the supply of secondary air. Because of this limitation, it frequently happens that cooling air is made available at a very high pressure and that high losses occur before the cooling air reaches a desired pressure level, which may be very much lower than the pressure level at which it is made available. In this case, a further problem consists in the fact that the temperature of the cooling air is very high because simply reducing the pressure does not reduce the stagnation temperature of the cooling air.

A particularly critical situation arises in the case of the low supply pressure level of a compressor when the inlet guide vanes of the compressor are substantially closed. In this case, the low supply pressure, which would be approximately 2 bar with the inlet guide vanes fully open, can fall below the ambient pressure. As a consequence of this, the lowest permissible supply pressure for supplying the bearings with sealing air and the last turbine disk with cooling air would be up to 5 bar, although a positive pressure of 200 mbar would be sufficient.

SUMMARY OF THE INVENTION

Accordingly, one object of the invention is to provide a novel method and appliance by means of which the cooling air, or a gas flow in general, can be lowered with good efficiency from a comparatively high initial pressure and a comparatively high initial temperature to a more suitable lower level of pressure and temperature.

The object is achieved by the totality of the features of claim 1 and of claim 4. The core of the invention consists in lowering the pressure and the temperature of the inlet-end gas flow in several steps by combination with a further gas flow, of lower pressure and lower temperature, in a favorable manner—in terms of energy—in a cascade of energy exchangers.

There is a plurality of different types of energy exchangers which can be employed in such a cascade, including turbochargers, pressure-wave machines, Ranque-Hilsch tubes or simple jet injectors. In each case, a gas flow at high pressure and a gas flow at low pressure are combined in such individual energy exchangers to provide a resultant gas flow with a medium pressure. A first preferred embodiment of the method according to the invention is therefore one wherein, from a first mass flow with a first pressure and a first temperature and a second mass flow with a second pressure and a second temperature, which are smaller than the first pressure and the first temperature, a resultant third mass flow with a third pressure and a third temperature is generated in each of the energy exchangers, which third pressure and third temperature lie between the first and the second pressures and the first and second temperatures, wherein the respective third mass flow of the second and all further energy exchangers is divided into two partial flows, wherein the first partial flow is used as the first mass flow of the following energy exchanger within the cascade, wherein the second partial flow is used as the second mass flow of the preceding energy exchanger within the cascade, wherein the first gas flow is fed into the first energy exchanger as the first mass flow, wherein the second gas flow is fed into the last energy exchanger as the second mass flow, and wherein the first partial flow of the last energy exchanger is extracted from the cascade as the resultant gas flow.

The differences between the various types of energy exchangers are essentially associated with the different fields of application, with different complexity and different effectiveness. The simplest class of energy exchangers are the so-called direct fluid/fluid energy exchangers, which include the jet injector and the Ranque-Hilsch tube. In accordance with a second preferred embodiment of the method, therefore, it is possible to achieve high effectiveness in a particularly simple manner if the energy exchangers are configured as jet injectors, i.e. if in each of the energy exchangers of the cascade, the first and the second mass flows are respectively injected as a jet into a mixing space and are there mixed with one another to form the third mass flow.

The appliance for carrying out the method according to the invention is one wherein a plurality of energy exchangers are connected in series in a cascade, wherein each of the energy exchangers has two inlet openings and one outlet opening, wherein the outlet opening of one energy exchanger is respectively connected to the first inlet opening of the following energy exchanger, wherein means are present which respectively feed back a partial flow from the outlet opening of an energy exchanger to its second inlet opening, wherein the first inlet opening of the first energy exchanger is provided as the high-pressure inlet for feeding in the first gas flow, wherein the second inlet opening of the last energy exchanger is provided as the low-pressure inlet for feeding in the second gas flow, and wherein the outlet opening from the last energy exchanger is provided as the medium-pressure outlet for extracting the third gas flow.

An embodiment of the appliance according to the invention which is preferred because of its simplicity is one wherein each of the energy exchangers is configured as a jet injector and each has a mixing space through which the gases flow, wherein two nozzle-shaped inlets, which form the two inlet openings of the energy exchanger, are provided upstream of the mixing space, and wherein an outlet, which forms the outlet opening of the energy exchanger, is arranged downstream of the mixing space.

A very compact construction for the complete cascade can be achieved by an arrangement wherein the injector cascade is made up of a plurality of semicircular tube segments, which are stepped in diameter, which are alternately and concentrically arranged on both sides of a central plane and whose open sides are oriented relative to the central plane in such a way that the tube segments engage with one another and that mixing ducts, which are connected to one another in the manner of a cascade, are respectively formed between two sequential tube segments on the same side of the central plane.

Further embodiments follow from the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with embodiment examples and the accompanying drawing, wherein.

DESCRIPTION OF THE PREFERRED EMBODIMENTS

Figure 1:
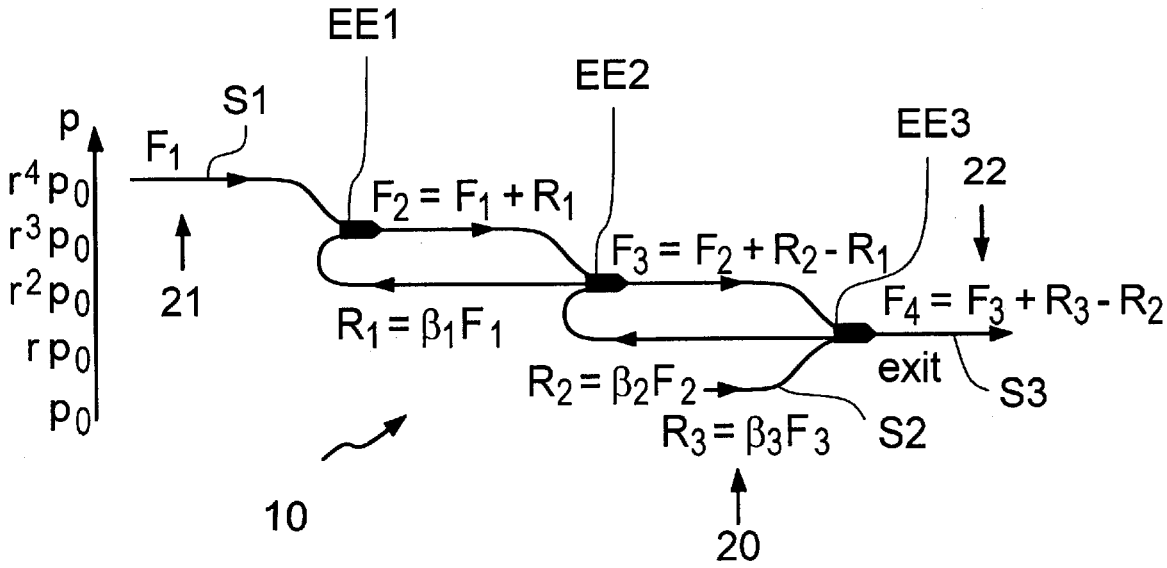
FIG. 1 shows a basic diagrammatic arrangement of a three-stage cascade with jet injectors with the associated pressure levels and mass flows in accordance with a preferred embodiment example of the invention.

Referring now to the drawings, wherein like reference numerals designate identical or corresponding parts throughout the several views, the basic diagrammatic arrangement of a three-stage cascade with jet injectors in accordance with a preferred embodiment of the invention is given in FIG. 1, together with the associated pressure levels and mass flows. The cascade 10 comprises three energy exchangers EE1, . . . , EE3, which are configured as jet injectors, which are arranged in series and which are connected to one another in characteristic manner. The representation selected is simultaneously located on a pressure scale p in such a way that the respective pressure levels $p_0$ to $r^4p_0$ in the individual stages of the cascade can be recognized (the significance of the parameters $p_0$ and $r^4$ is given in the explanations further below). A first gas flow S1 with a high pressure $r^4p_0$ (and a high temperature) is fed in at the left-hand high-pressure inlet 21 of the cascade as the mass flow $F_1$ in a first inlet opening (high-pressure inlet opening) of the first energy exchanger EE1 of the cascade 10. A second mass flow $R_1$ with a lower pressure $r^2p_0$ (and a lower temperature) enters a second inlet opening (low-pressure inlet opening) of the first energy exchanger EE1. A mass flow $F_2$ combined from the mass flows $F_1$ and $R_1$ and having a medium pressure $r^3p_0$ (and a medium temperature) is then available at the outlet opening of the energy exchanger EE1. The combined mass flow $F_2=F_1+R_1$ is supplied to the first inlet opening of the following energy exchanger EE2, whose second inlet opening is subjected to a further mass flow $R_2$ with the pressure $rp_0$. A further mass flow $F_2+R_2$ with the medium pressure $r^2p_0$ produced by the two inlet-end mass flows $F_2$ and $R_2$ occurs at the outlet.

The mass flow $R_1=\beta_1F_1$ is branched off as a partial flow from this outlet-end mass flow $F_2+R_2$ and is fed back to the second inlet opening of the first energy exchanger EE1. The residual mass flow $F_3=F_2+R_2-R_1$ from the outlet opening of the second energy exchanger EE2 enters the first inlet opening of the following third energy exchanger EE3 in the cascade 10. A gas flow S2, as the mass flow $R_3=\beta_3F_3$ with the lowest pressure $p_0$ is supplied externally to the second inlet opening of the third energy exchanger EE3, which forms a low-pressure inlet 20. The mass flow $F_3+R_3$, produced from the two mass flows, appears at the outlet opening of the third energy exchanger EE3 and, from this, the partial flow $R_2=\beta_2F_2$ is branched off and fed back to the second inlet opening of the preceding energy exchanger EE2. The residual mass flow $F_48=F_3+R_3-R_2$ is available as the gas flow with reduced pressure $rp_0$ (and reduced temperature) at the medium-pressure outlet 22 of the cascade 10. If the cascade is provided with further stages or energy exchangers, the gas flows or mass flows follow corresponding paths.

Figure 2:
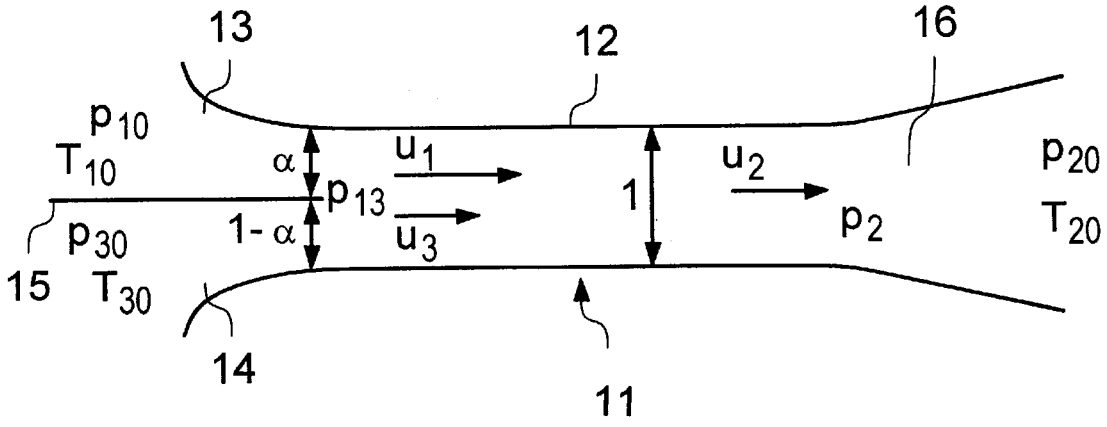
FIG. 2 shows the construction in principle of an individual jet injector with mixing tube, with the parameters necessary for a calculation.

The basic situation in the case of an individual injector can be considered in relation to FIG. 2. The diagrammatic jet injector 11 shown there consists of a central mixing tube 12 with flow through it from left to right. Two nozzle-type inlets 13 and 14, separated from one another by a separating wall 15, are provided on the (left-hand) inlet end of the mixing tube 12. There is an outlet opening 16 on the right-hand end of the mixing tube 12. Various parameters, provided with indices, are included in FIG. 2. The subscripts "1", "2", "3" and "13" refer to different locations within the jet injector 11. An additional "0" at the end of the subscript designates an associated stagnation condition. The parameters p, T, u and $\alpha$ refer to the pressure, the temperature, the flow velocity and the ratio of the cross-sectional area of the high-pressure inlet 13 to the cross-sectional area of the mixing tube 12. Further parameters, not included in FIG. 2 but occurring in the following equations, are the density $\rho$, the sonic velocity c, the Mach number M, the ratio $\gamma$ of the specific heats and the specific heat $c_p$ at constant pressure.

The following relationships apply to loss-free flows through the inlets 13 and 14:

$$\frac{p_{10}}{p_{13}}=\left(1+\frac{\gamma-1}{2}M_1^2\right)^{\frac{\gamma}{\gamma-1}},\ \frac{p_{30}}{p_{13}}=\left(1+\frac{\gamma-1}{2}M_3^2\right)^{\frac{\gamma}{\gamma-1}}. \tag{1}$$

The conservation of momentum across the mixing zone of the injector 11 gives:

$$p_{13}+\alpha\rho_1u_1^2+(1-\alpha)\rho_3u_3^2=p_2+\rho_2u_2^2. \tag{2}$$

The condition of the conservation of mass can be formulated as follows:

$$\alpha\rho_1u_1+(1-\alpha)\rho_3u_3=\rho_3u_2, \tag{3}$$

and, if the specific heats are assumed to be constant, the conservation of energy across the mixing zone requires:

$$\alpha\rho_1u_1T_{10}+(1-\alpha)\rho_3u_3T_{30}=\rho_2u_2T_{20}. \tag{4}$$

Also applicable are the equation of state $$\frac{p}{\rho T}=\frac{\gamma-1}{\gamma}c_p, \tag{5}$$

and the conditions for isentropic flow $$\frac{p}{p_0}=\left(\frac{\rho}{\rho_0}\right)^{\gamma}=\left(\frac{T}{T_0}\right)^{\gamma-1^{\gamma}}=\left(\frac{c}{c_0}\right)^{\frac{2\gamma}{\gamma-1}}. \tag{6}$$

in order to relate the local parameters to the corresponding parameters under stagnation conditions.

On the basis of Equations (1) to (6), it is now possible to associate the conditions at inlet and outlet of the jet injector 11 with one another. If it is also assumed that the area ratio $\alpha$ and the pressure ratio per stage $r=p_{n+1,0}/p_{n,0}$ are the same for all jet injectors, the jet injectors or energy exchangers of FIG. 1 can be combined to provide the corresponding cascade 10. If the mass flow directed forward from stage n to stage n+1 is designated by $F_n$ and the mass flow returned from stage n+1 to stage n is designated by $R_n$, the conservation of mass provides the following relationship:

$$F_{n+1}=F_n+R_n-R_{n-1}. \tag{7}$$

On the other hand, the solution of Equations (1) to (6) for specified stagnation pressure and temperature relationships, leads to a relationship of the form:

$$R_n=\beta_n F_n, \tag{8}$$

where the proportionality factor $\beta_n$ is a measure of the effectiveness of the $n^{th}$ stage of the cascade 10. If it is assumed that the cascade is composed of N stages, then N−1 injectors must be connected together. In this case, the pressure ratio between the high-pressure inlet opening and the low-pressure inlet opening, $r_{total}=r^N$, while the pressure ratio between the outlet opening and the low-pressure inlet opening is r.

If the stagnation temperatures at high pressure and low pressure are designated by $T_{HP0}$ and $T_{LP0}$, the ratios of the mass flows at the high-pressure inlet openings and the low-pressure inlet openings $\dot{m}_{HP}$ and $\dot{m}_{LP}$ can be expressed as follows for a loss-free energy exchanger cascade:

$$\frac{\dot{m}_{LP}}{\dot{m}_{HP}}=\frac{T_{HP0}}{T_{LP0}}\frac{1-\gamma^{-(N-1)\gamma-\frac{3}{\gamma}}}{\gamma^{\frac{\gamma-1}{\gamma}}-1}. \tag{9}$$

The effectiveness $\eta_E$ of the energy exchange of the complete cascade 10 can then be expressed by $$\eta_E=\left(\frac{F_N}{R_{N-1}}-1\right)\frac{\dot{m}_{HP}}{\dot{m}_{LP}}=\left(\frac{F_N}{R_{N-1}}-1\right)\frac{T_{LP0}}{T_{HP0}}\frac{\gamma^{\frac{\gamma-1}{\gamma}}-1}{1-\gamma^{-(N-1)\gamma-\frac{1}{\gamma}}}. \tag{10}$$

EXAMPLE

A cascade with 7 jet injectors (N=8) has the following conditions at the high-pressure inlet opening and the low-pressure inlet opening:

$$p_{HP0}=5.10^5\ \text{Pa},\ T_{HP0}=480\ \text{K},\ p_{LP0}=10^5\ \text{Pa},\ T_{LP0}=288\ \text{K}. \tag{11}$$

Figure 3:
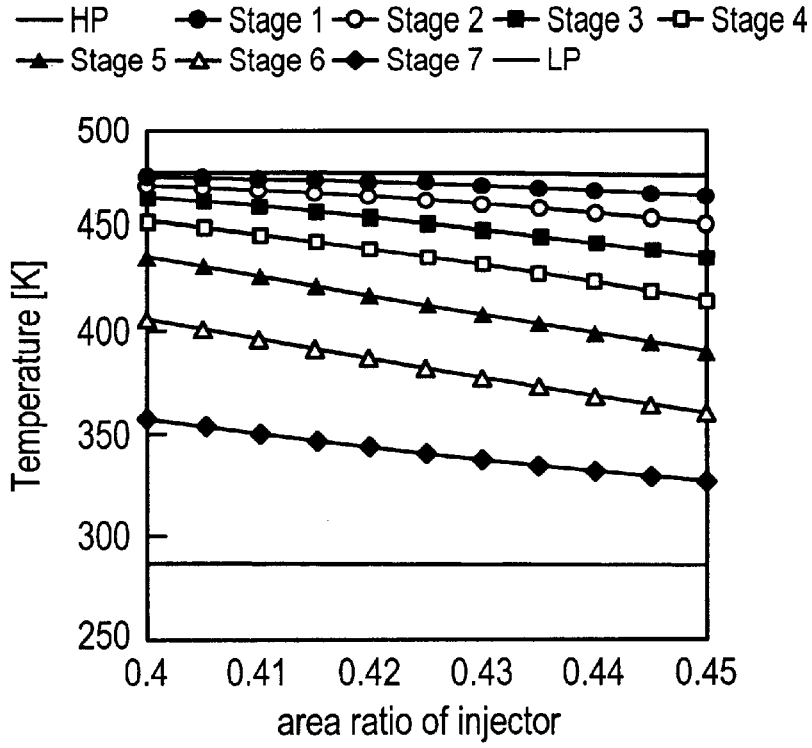
FIGS. 3–11 show various diagrams with calculated characteristic parameters of a typical seven-stage cascade, with injectors as shown in FIG. 2, as a function of the ratio of the inlet cross section.
Figure 4:
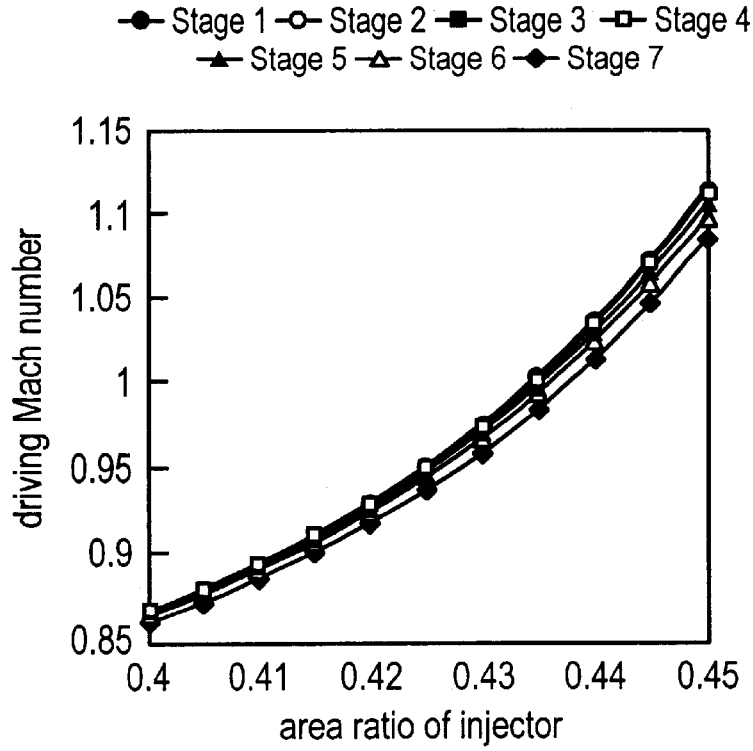
Figure 5:
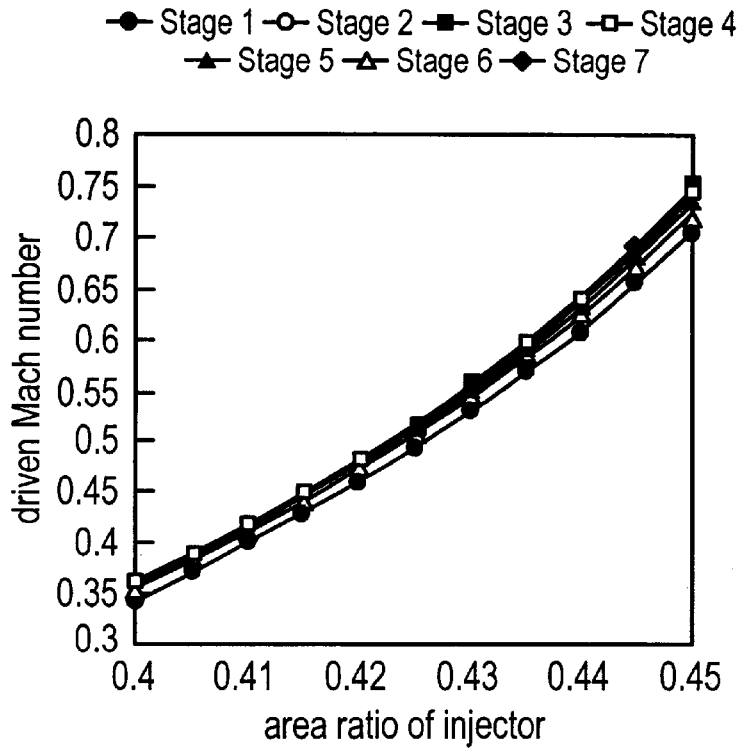
Figure 6:
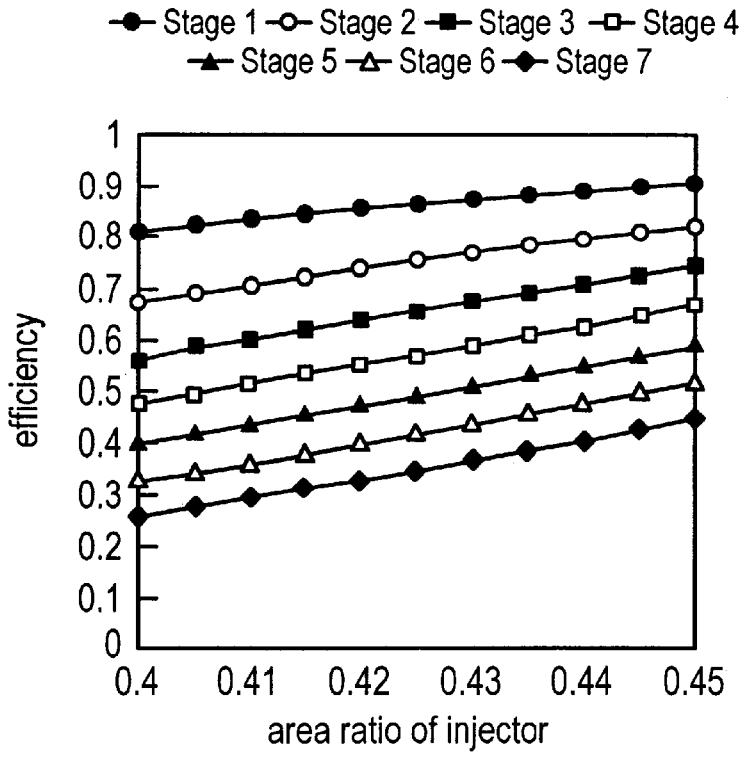
Figure 7:
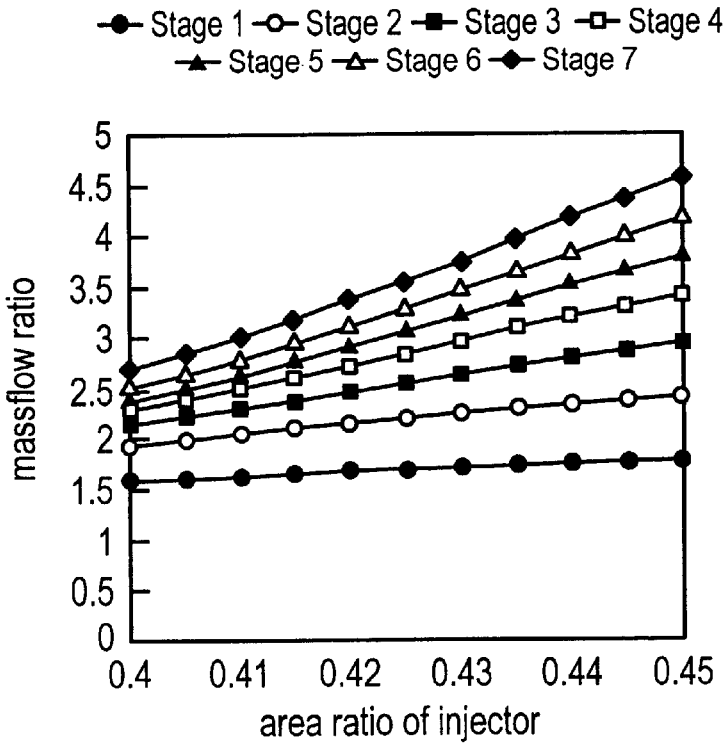
Figure 8:
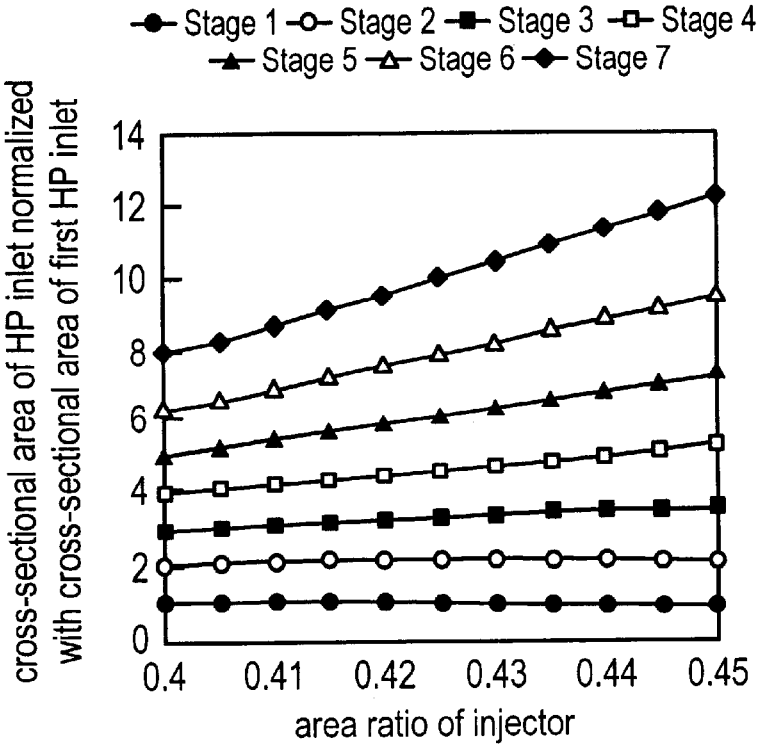
Figure 9:
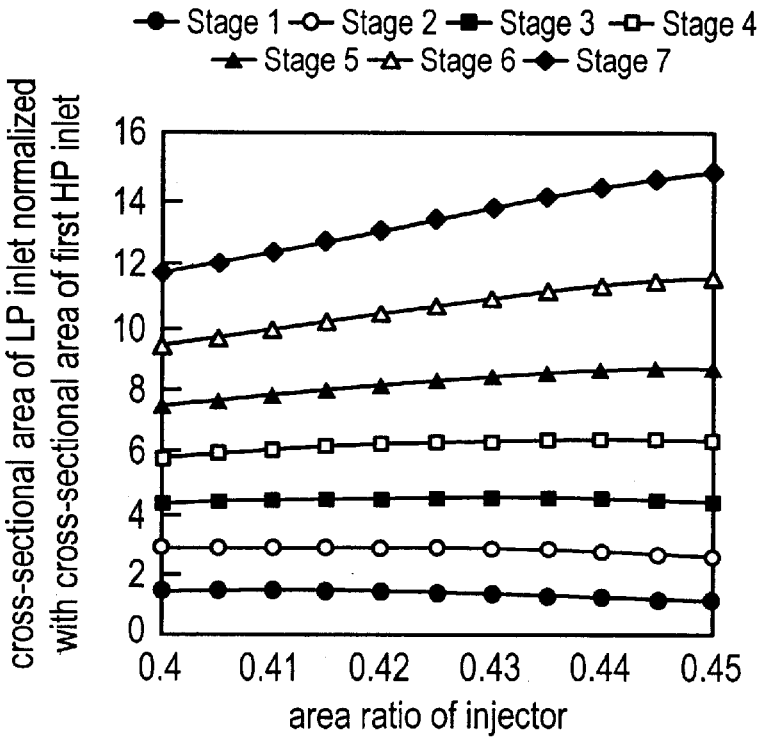
Figure 10:
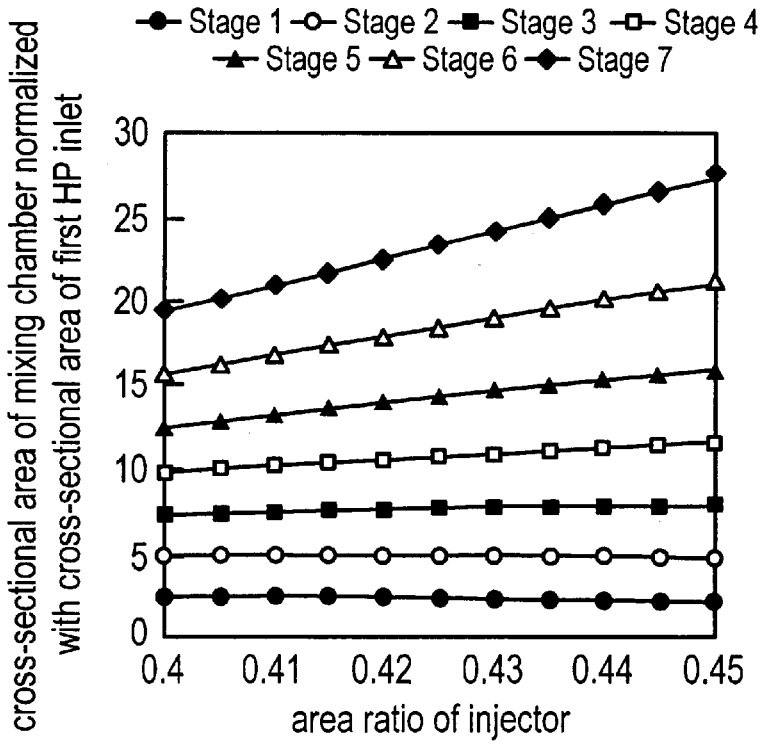
Figure 11:
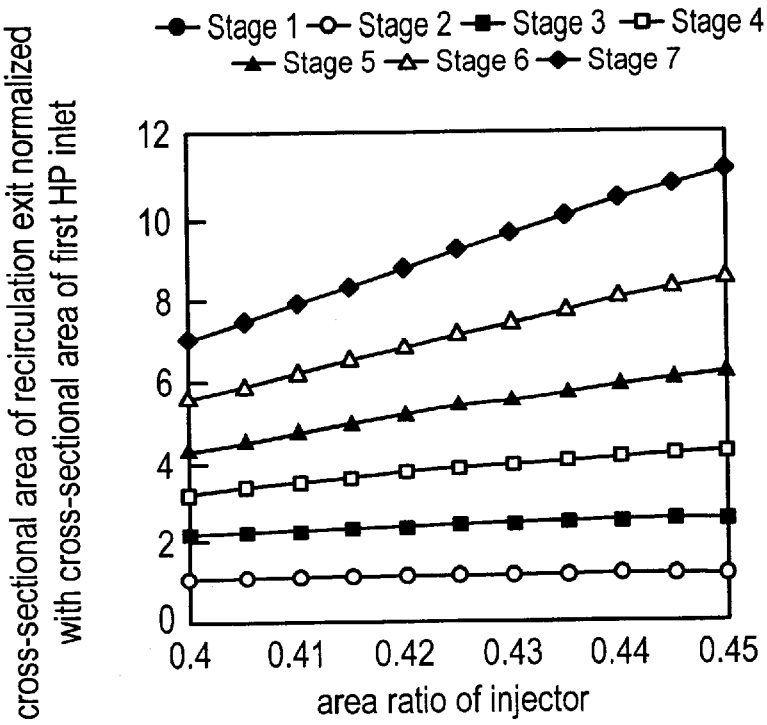

The results calculated under these conditions for various parameters are given in FIGS. 3 to 11. FIG. 3 shows the calculated stagnation temperatures in all stages of the cascade as a function of the area ratio α of the individual jet injector shown in FIG. 2. FIGS. 4 and 5 show the Mach numbers of the inlet-end flows at the respective high-pressure and low-pressure inlet openings (inlet 13 or 14) of the individual injector. FIG. 6 shows the cumulative effectiveness at each stage of the cascade, including the total effectiveness, which is achieved in the seventh stage. It should also be pointed out that the validity of the results is limited to the case of subsonic flows. It is not advisable to increase the Mach numbers (FIG. 4) substantially above 1. The Prandtl-Meyer angles which would occur due to a supersonic expansion, would lead to a deterioration in the energy exchange effectiveness. For this reason (see FIG. 4), the cascade should be designed in the neighborhood of α=0.435, where the total effectiveness is approximately 0.4 and the ratio of the total mass flows, from FIG. 7, is approximately 4.

A decrease or increase in the number of stages leads to a decrease or increase in the cascade effectiveness. For a large pressure ratio, however, it is scarcely possible to achieve a cascade effectiveness of more than 0.5. A typical range of the effectiveness which can be achieved with a suitable number of stages is located somewhere between 0.35 and 0.5. The geometry or design of the cascade is established by FIGS. 8 to 11 which show, normalized with respect to the cross-sectional area of the first high-pressure inlet of the cascade, the cross-sectional area of the respective high-pressure inlet of an energy exchanger (FIG. 8), of the respective low-pressure inlet of an energy exchanger (FIG. 9), of the respective mixing chamber of an energy exchanger (FIG. 10), and of the respective outlet for the returned partial flow of an energy exchanger (FIG. 11) as a function of the area ratio α. It should be noted that the match between the outlet and inlet areas of sequential stages is relatively good. For this reason, it is not necessary to sacrifice a large amount of kinetic energy for retardation after an outlet and acceleration before an inlet. The transitions between the stages can therefore be kept fairly fluid.

Figure 12:
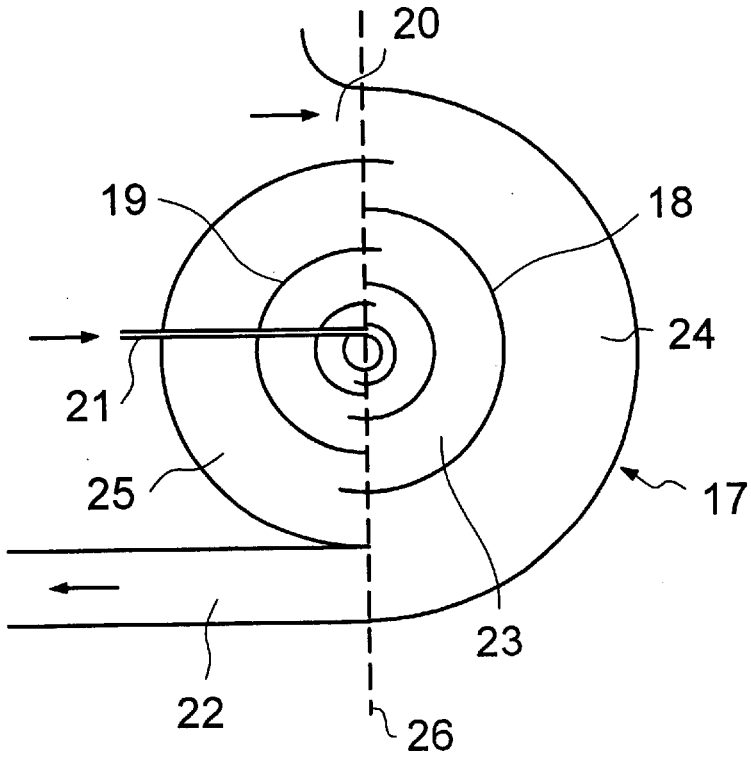
FIG. 12 shows, in cross section, a preferred embodiment example of a compact jet injector cascade composed of concentric semicircular tube segments.

A very simply constructed and compact injector cascade 17 for carrying out the method according to the invention can be realized, as shown in FIG. 12, by a plurality of semicircular tube segments (half-tubes) 18, 19, which are stepped in diameter, being arranged concentrically and alternately on both sides of a central plane 26 in such a way that a curved mixing duct 23–25 is respectively formed on both sides of the central plane 26 between sequential tube segments. The tube segments 18, 19 are interlaced in such a way that each mixing duct on one side of the central plane 26 is simultaneously connected at both ends to two mixing ducts on the other side of the central plane 26. The innermost mixing duct is connected to the high-pressure inlet 21, the outermost mixing duct 24 is connected to the low-pressure inlet 20 and the medium-pressure outlet 22. It is obvious that the arrangement of tube segments (half-tubes) is bounded and closed at both ends by corresponding end plates.

Overall, the invention provides a simple possibility of generating a gas flow of medium pressure with high efficiency from a high-pressure gas flow, the medium pressure gas flow being particularly suitable for the provision, from the compressor, of cooling air for a gas turbine.

Obviously, numerous modifications and variations of the present invention are possible in light of the above teachings. It is therefore to be understood that within the scope of the appended claims, the invention may be practised otherwise than as specifically described herein.

What is claimed as new and desired to be secured by Letters Patent of the United States is:

1. A method of generating a third gas flow of medium pressure and medium temperature, which can be employed, in particular, as cooling air for a gas turbine, from a first gas flow of high pressure and high temperature, wherein the reduction is undertaken by stepwise energy exchange between the first gas flow and a second gas flow of low pressure and a low temperature in a cascade comprising a plurality of energy exchangers connected in series.

2. The method as claimed in claim 1, wherein from a first mass flow with a first pressure and first temperature an a second mass flow with a second pressure and a second temperature, which are smaller than the first pressure and the first temperature, a resultant third mass flow with a third pressure and a third temperature is generated in each of the energy exchangers, which third pressure and third temperature lie between the first and second pressures and the first and second temperatures, wherein the respective third mass flow of the second and all further energy exchangers is divided into two partial flows, wherein the first partial flow is used as the first mass flow of the following energy exchanger within the cascade, wherein the second partial flow is used as the second mass flow of the preceding energy exchanger within the cascade, wherein the first gas flow is fed into the first energy exchanger as the first mass flow, wherein the second gas flow is fed into the last energy exchanger as the second mass flow, and wherein the first partial flow of the last energy exchanger is extracted from the cascade as the resultant gas flow.

3. The method as claimed in claim 2, wherein, in each of the energy exchangers of the cascade, the first and second mass flows are respectively injected as a jet into a mixing space and are there mixed with one another to form the third mass flow.

4. A gas turbine, comprising:

a plurality of energy exchangers, including a first energy exchanger and a last energy exchanger, which are connected in series in a cascade;

each of the plurality of energy exchangers have two inlet openings and one outlet opening, the outlet opening of one of the plurality of energy exchangers is respectively connected to the first inlet opening of a following of the plurality of energy exchangers;

a means for feeding back a partial flow from the outlet opening of a following energy exchangers to the second inlet opening of a preceding energy exchanger in the cascade;

a high-pressure inlet located in the first inlet opening of the first energy exchanger, for feeding a first gas flow;

a low-pressure inlet located in the second inlet opening of the last energy exchanger for feeding a second gas flow; and a medium-pressure outlet located in the outlet opening from the last energy exchanger for extracting the third gas flow.

5. The gas turbine of claim 4, wherein each of each of the plurality of energy exchangers is configured as an injector and each has a mixing space through which the gases flow, wherein two nozzle-shaped inlets, which form the two inlet openings of the energy exchanger, are provided upstream of the mixing space, and wherein an outlet, which forms the outlet opening of the plurality of energy exchangers is arranged downstream of the mixing space.

6. The gas turbine of claim 5, wherein the mixing space is configure as a mixing tube.

7. The gas turbine of claim 5, further comprising an injector cascade which is made up of a plurality of semicircular tube segments which are alternately and concentrically arranged on both sides of a central plane and open sides are oriented relatively to the central plane in a way that the tube segments engage with one another and that mixing ducts, which are connected to one another in a manner of the cascade, are respectively formed between two sequential tube segments.

* * * * *